United States Patent [19]

Von Tomkewitsch et al.

[11] 4,222,041

[45] Sep. 9, 1980

[54] DANGER ALARM SYSTEM

[75] Inventors: Romuald Von Tomkewitsch, Ebenhausen; Otto W. Moser, Munich, both of Fed. Rep. of Germany

[73] Assignee: Siemens Aktiengesellschaft, Berlin & Munich, Fed. Rep. of Germany

[21] Appl. No.: 29,392

[22] Filed: Apr. 12, 1979

[30] Foreign Application Priority Data

Apr. 19, 1978 [DE] Fed. Rep. of Germany ..... 2817089

[51] Int. Cl.[2] ..... G08B 29/00

[52] U.S. Cl. ..... 340/517; 340/505; 340/506

[58] Field of Search ..... 340/500, 505, 506, 517, 340/518, 519, 521, 524

[56] References Cited

U.S. PATENT DOCUMENTS 4,067,008 1/1978 Sprowls ..... 340/505

*Primary Examiner*—Alvin H. Waring

*Attorney, Agent, or Firm*—Hill, Van Santen, Steadman, Chiara & Simpson

[57] ABSTRACT

A danger alarm system, for example, fire alarm system, utilizing a plurality of detectors which are connected to a central exchange over respective call circuits, the central exchange is provided with a memory in which characteristic data for each connectable detector can be stored. Data is cyclically sampled from the respective individual detectors and simultaneously therewith rated values for the corresponding detector are formed from the stored data and compared with the sampled data and, if necessary, alarm or trouble signals are derived from the comparison results.

16 Claims, 4 Drawing Figures

DANGER ALARM SYSTEM

BACKGROUND OF THE INVENTION

The invention relates to a danger alarm system utilizing a plurality of alarm devices which are connected to a central exchange over call circuits, whereby the state of the individual alarms can be sampled in the central exchange by means of test control units and can be evaluated for the formation of an alarm or trouble signal by means of an evaluation installation.

Such alarm systems are known, for example, in a form of public or private auxiliary alarm systems and in general, such systems are modularly designed, whereby a plurality of lines can usually be connected to the switching component groups in the central exchange, and a plurality of fire alarms connected to each line. It is possible, by means of so-called chain synchronization, to transmit the data of the individual alarm devices, in analog form, on a common line. See for example German O.S. No. 2,641,489. In such systems, it is also necessary to properly further process the information received from the alarm devices actually switched on and to insure that the system components are not switched on and do not produce interference, and that each and every change in the system configuration is recognized.

In traditional systems, the relaying of the alarm information was transmitted over special classification lines which, on demand, had to be interrupted. In addition, it was also customary to simulate system parts that did not exist, i.e. to simulate an operable interface by means of a special terminal element. Operations of this type were manually performed in the system usually utilizing screwdrivers or soldering irons. Such activity involves a great deal of working time and is always subject to the danger that lines can be mistaken and incorrectly connected.

The invention has among its objects the creation of a danger alarm system, of the type initially referred to, in which such classifications in wiring are not required. Constant monitoring of the alarm configuration should be guaranteed, identification of the alarm devices which are connected to a common line, as well as to enable an evaluation of different types of alarm systems within the same lines, should be provided, and further, desired changes in the alarm configuration should be achieved in a simple manner.

These objectives are achieved, in accordance with the invention, by the provision of a memory in the central exchange, in which, for each of the arm devices connectable in the system, the seizure data as well as various data characteristic of the respective alarms is stored. A line sampling installation is provided by means of which the individual alarm lines can be cyclically sampled, and by means of which the alarm data arriving from the individual lines can be supplied to a cooperable evaluation installation. In addition, a memory sampling installation is provided by means of which, upon each step of the line sampling installation, the storage locations for all alarms connected to the line involved can be interrogated, whereby the memory content is supplied to the evaluation installation for the formation of rated values. The evaluation installation is also provided with a comparison installation in which the data arriving from the individual alarm lines can be compared with the rated values formed from the stored data and can be processed for the formation of trouble or alarm signals if required.

In accordance with the invention, the memory provided in the central exchange thus contains data relating to the plurality of connected alarm lines, as well as relating to the plurality of alarm devices associated with each line, which memory locations can be entered either over input means, for example a key board, or automatically by means of a microcomputer. At the beginning of the operation system, a test can be carried out, for example, to see whether or not a line is connected, as well as to see how many alarm devices per line are connected. It is thereby possible to ascertain whether the individual alarm devices are in a quiescent, an alarm, or a disrupted condition.

In addition, it is possible to group individual alarms together in predetermined groups independent of the actual position on the alarm line, for example, grouping of alarm devices of the same type which either spatially belong together, or are to be processed according to the same evaluation criteria. Thus, it is possible to intentionally cause all similar alarms, for example, smoke alarms, of the system to respond and enter the common criterium, i.e. "smoke alarm" into the memory for all addressed alarm devices, by means of a suitable command. During the memory sampling, this alarm criterium is then supplied and correspondingly taken into consideration during the rated value formation.

All information which represents the actual condition of the alarm configuration, and stored in the system, can be supplied over a dialogue terminal for comparison with the desired rated condition. As soon as the actual condition for a part of the system or for the entire system has been determined to be free of error and entered, the system can be placed in operation by means of a corresponding switch, whereby the rated condition is the actual condition, and all deviations therefrom will thereafter be recognized as trouble.

Expediently, a microprocessor can be employed for control of the line sampling installation, of the memory sampling installation and of the evaluation installation which microprocessor is connected with a corresponding memory as well as with an input installation and an output installation.

BRIEF DESCRIPTION OF THE DRAWINGS

Wherein like reference characters indicate like or corresponding parts.

DETAILED DESCRIPTION

Figure 1:
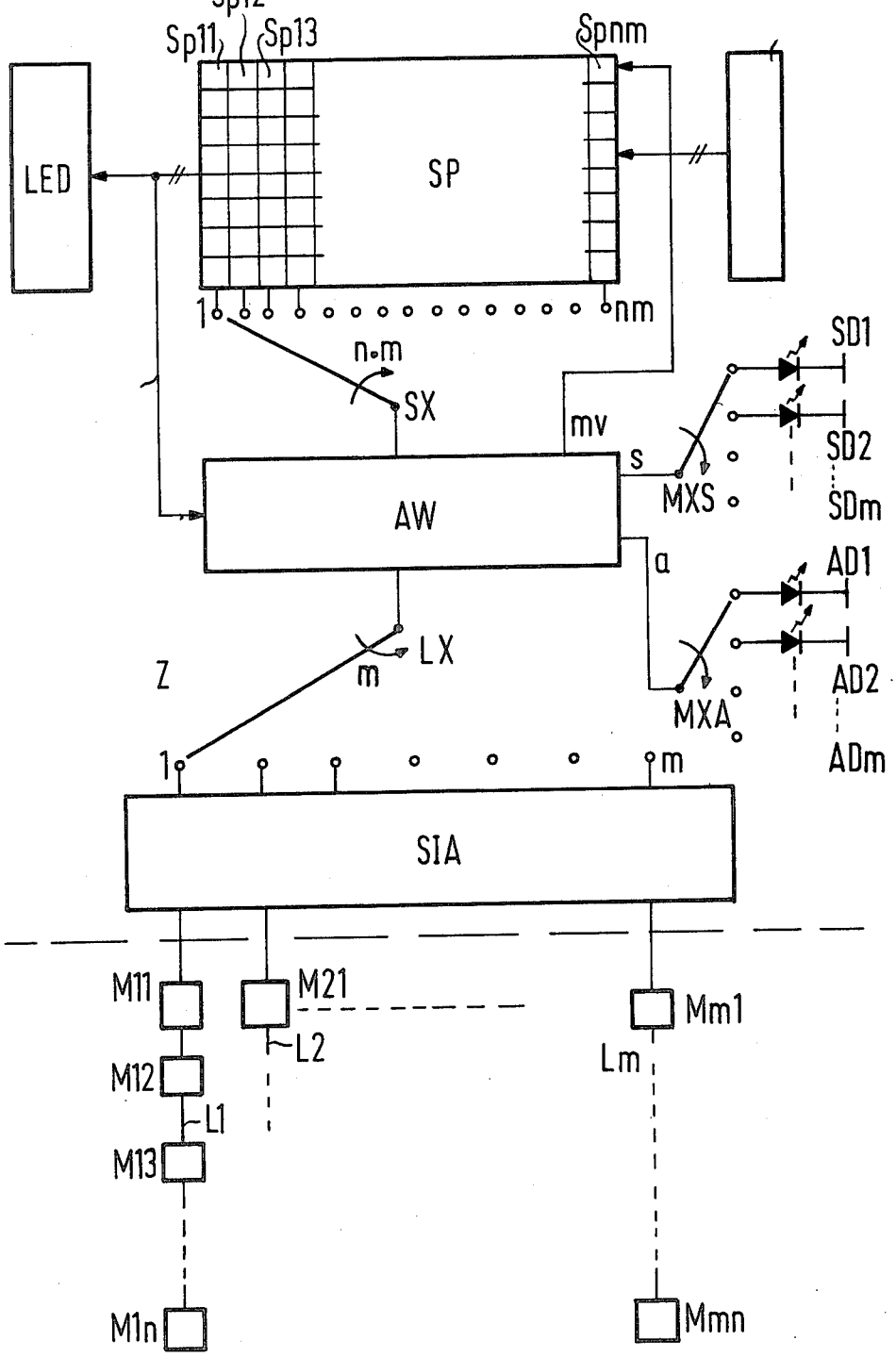
FIG. 1 is a block diagram of a danger alarm system in accordance with the present invention.

Referring to FIG. 1, which illustrates the general construction of a danger alarm system in accordance with the invention, the central exchange Z includes an evaluation installation AW which is operatively connected with a memory SP. The evaluation installation controls a line sampling installation in the form of a multiplexer LX (illustrated for simplicity as a rotary switch) which cyclically samples the individual alarm lines represented by the lines L1 through Lm, over an interposed signal adapter SIA which converts the data arriving on the lines into processable signals. The evaluation installation AW also controls a memory sampling installation SX which likewise is designed as a multiplexer (illustrated for simplicity as a rotary selector). The memory sampling installation is designed to process as many steps as there are alarms connectable to the system. Thus, if m lines are provided with a plurality of n alarms for each alarm line, the line sampling installation LX is advanced one step for each n steps of the memory sampling installation, whereby a total of m times n steps are involved.

The circuitry of the individual alarm lines can, for example, by comparable to those described in German AS No. 2,533,382 or German OS No. 2,641,489. In such case, the alarms connected in serial succession on the lines L1 through Lm are respectively connected to the line with a time delay corresponding to the data of the alarm concerned, with the resultant stepped current respectively characterizing the alarm addresses by means of the step factor and the data by means of the step length. Such current steps are converted into pulses in the signal adapter installation SIA, which pulses are then supplied to the evaluation installation AW over the line sampling installation LX. When the system is placed in operation, the information is supplied from the evaluation installation AW to the memory SP, together with other data input by means of an input installation EIN. The memory state can be monitored by means of a light emitting diode display LED (illustrated in FIG. 2).

During operation of the system, the data contained in the memory SP for each alarm device is supplied over an output multiplex AUS to the evaluation installation AW and there utilized for the formation of set values which are then compared with the sampled actual values of the individual alarm devices, as will be hereinafter described in greater detail. If such comparison leads to the formation of an alarm signal a, such signal is then utilized in the creation of an alarm display over the multiplex output MXA. Such output multiplex runs synchronously with the line sampling installation LX and controls a display installation which has a light emitting diode AD1. . . ADm for each alarm line. The display may be stabilized, for example, by means of flip-flops not illustrated in the drawings. If required, the output multiplexer MXA could also run synchronously with the memory sampling installation SX, in which case a display could be controlled for each individual alarm. Similar to the alarm signal, a trouble signal s formed in the evaluation installation is also supplied over a multiplex output MXS and employed for the control of light emitting diodes SD corresponding to the lines sampled.

Figure 2:
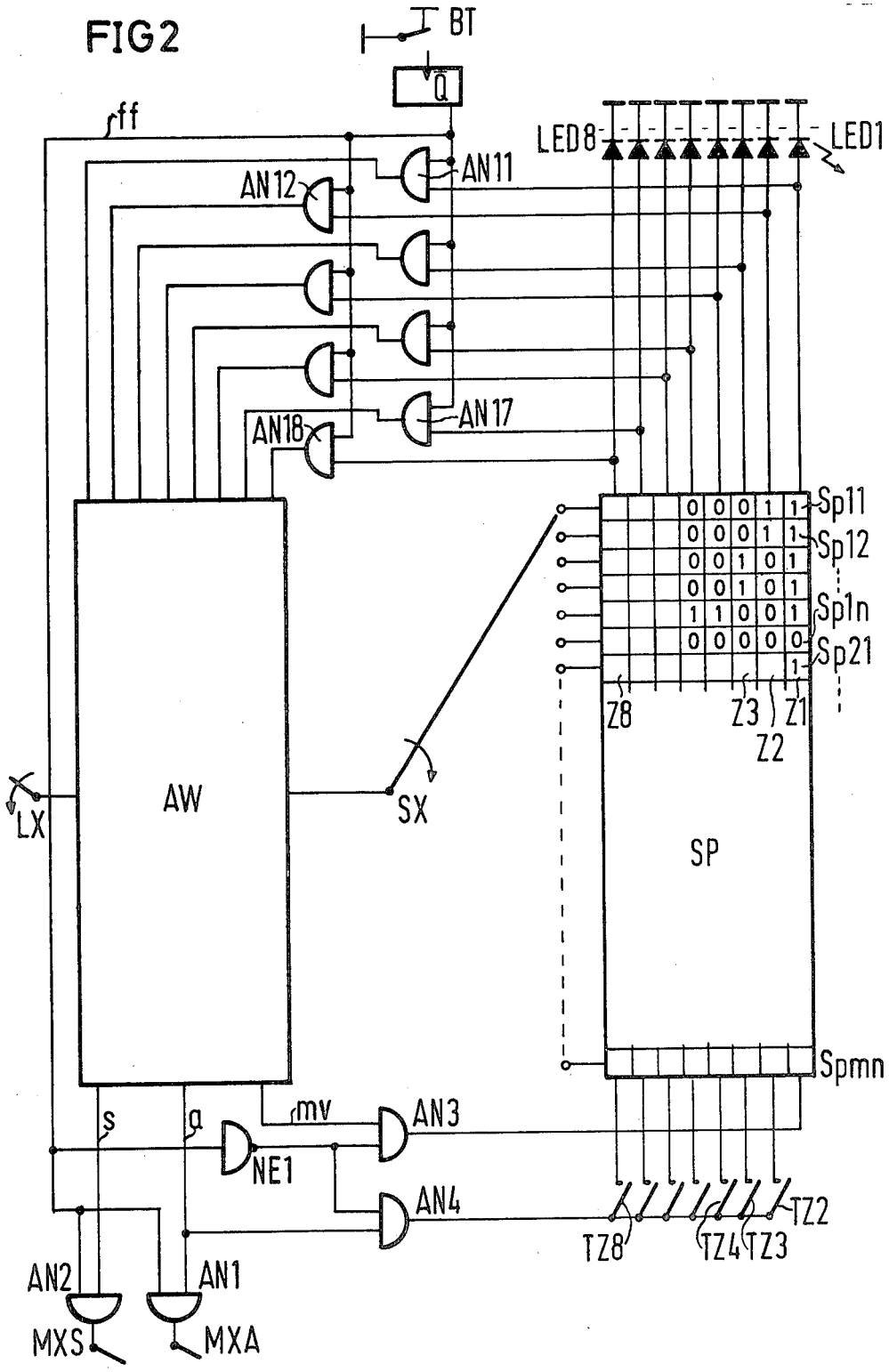
FIG. 2 illustrates, partially in block form, the construction of the memory and its connection with the evaluation installation illustrated in FIG. 1.

FIG. 2 illustrates, in greater detail, the construction and function of the memory SP. In the embodiment illustrated, such memory comprises a matrix of bistable memory elements whose number depends on the number of connected alarm devices and also on the number of items of information data per alarm device. When 8 bits are to be stored per alarm, and m alarm lines, each having n alarm devices, are to be employed in the system, the memory must have $8 \times n \times m$ cells. In the matrix illustrated, each alarm has a vertical column Sp11 . . . Spnm, whereas eight different criteria can be stored in the eight lines Z1 . . . Z8 for each alarm. The seizure of the alarm locations is respectively stored in the first line Z1. When the alarm concerned is connected, a "1" is stored and when the alarm location is not operatively connected, a "0" appears in the memory for the alarm location involved.

Information concerning the type of alarm can be stored in additional lines. This is practical because different rated values for the evaluation are required in dependence upon the physical measuring principle of an alarm. Thus, for example, all smoke alarms can be characterized with a "1" in line Z2, all heat alarms in line Z3, all flame alarms in line Z4, etc. Different sensitivities for the respective alarms can, for example, be stored in additional lines and likewise different time-delays can be prescribed, etc. The memory input is effected in such a manner that when the system is initially placed in operation, the AND elements AN1 and AN2 are initially blocked over the flip-flop FF to suppress the alarm and trouble reports. During the interrogation of the individual call circuits, the evaluation installation AW generates a signal at its output mv when the alarm location being examined at the moment is actually occupied. a logical "1" is entered into lines Z1 in the memory for the alarm device involved over the AND element AN3. The type of an alarm device can be stored, for example, by closing the respective switch TZ2, TZ3, etc., and then cause the associated alarm device involved to respond. For example, when switch TZ2 is closed, all smoke alarm devices of the entire system are permitted to respond resulting in a logical "1" being written into line 2 of the memory SP for each smoke alarm. Corresponding operations are effected with the remaining lines.

Sensitivity and retardation can be entered, together with the alarm signal a, over the AND element AN4 by closure of the corresponding switch TZ. After programming the memory SP, the system configuration can be monitored over the output multiplex AUS by means of the step-by-step control of the individual columns Sp11. etc., and all memory locations of each individual alarm can be tested by means of the light emitting diodes LED1 . . . LED8. If the configuration is deemed correct, the system can be placed in operation by closing the operational key BT. A logic 1 then appears at the output of the flip-flop FF, releasing and AND elements AN1 and AN2 for the alarm and trouble relaying, and the outputs AUS of the memory are likewise released to the evaluation installation over the AND elements AN11 through AN18.

Figure 3:
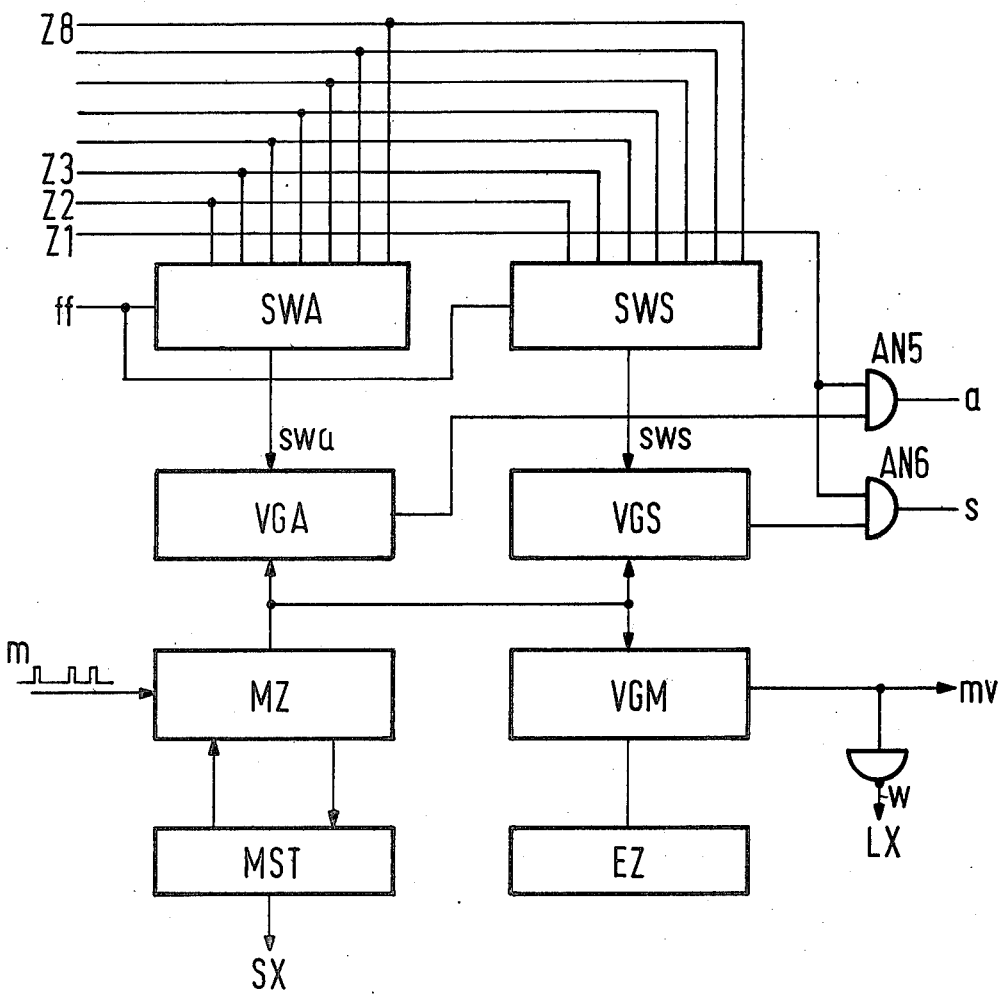
FIG. 3 illustrates the circuitry of the evaluation installation illustrated in FIG. 2.

The construction and function of the evaluation installation are illustrated in FIG. 3. As will be noted from FIG. 2, the lines Z1 through Z8 of the memory for the respective designated alarms are input into such evaluation circuit. These signals are supplied to value setting means SWA for alarm and value setting means SWS for trouble. The corresponding set values SWA or SWS are formed in such setting means as a respective function of the stored criteria. In the simplest case, such value setting means are constructed as counters, which, in dependence upon the indicated type of alarm device and the sensitivity selected therefor, respectively count to a more or less large value and then supply this value to the comparators VGA and VGS. At the same time, the evaluation installation AW receives the data resulting from the interrogation of the individual alarm devices from the signal adapter SIA.

As previously explained, such data appears as pulses on the line. The number of the pulses corresponds to the alarm device address, whereas the changing pulse interval is a measure of such data. The data m is supplied to the gate time counter MZ which may be designed as time meter. It counts with a constant clock pulse, whereby a smaller or larger counter value is supplied to the comparator VGA for alarms or to the comparator VGS for trouble, in dependence on the pulse interval. Upon the occurrence of a new data pulse, the gate time counter MZ is briefly arrested, its counter-reading is translated to the comparators VGA and VGS, following which the counter is reset. Simultaneously with the resetting of the gate time counter MZ, a step pulse is supplied to the multiplexer control MST and the memory sampling installation SX is advanced by one step. If it is assumed, for simplification, that such sampling installation is a rotary selector, then a multiplexer control MST would contain the rotary selector drive means which receives a step pulse with each resetting of the gate time counter MZ.

When an alarm line has been completely interrogated, the line sampling installation must be advanced to the next line. For this purpose, the final character EZ is supplied in the form of a maximum time existing at the comparator VGM. Consequently, when no further data pulse occurs up to this prescribed maximum time, the comparator VGM forms a step signal w with the signal of the gate time counter MZ, and by means of the signal w the line sampling installation LX is advanced by one step. As long as the maximum time value of the final character EZ has not been reached, a signal mv, which indicates the presence of an alarm, exists at the output of the comparator VGM.

Figure 4:
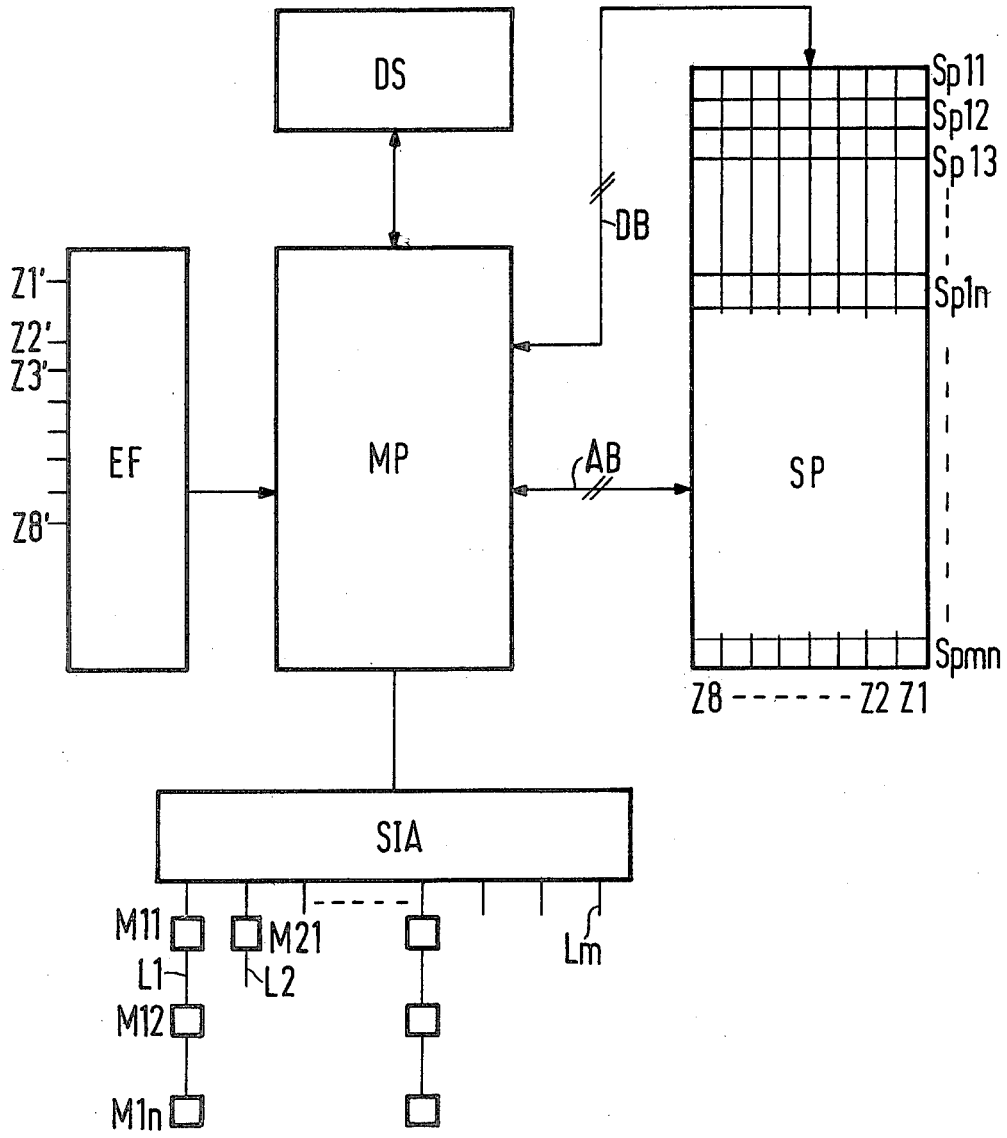
FIG. 4 illustrates the circuitry of an alarm system, in accordance with the invention, utilizing a microprocessor.

FIG. 4 illustrates the circuit diagram for a danger alarm system, in accordance with the invention, utilizing a microprocessor MP, with the functioning of the system being substantially the same as heretofore described with respect to the circuitry of FIGS. 1 and 2. Only the functioning of the respective components is controlled by the microprocessor which has respective data lines and command lines to the individual system components. The signal adapter SIA is constructed as previously described and delivers the respective line number and data to the microprocessor. The memory SP likewise is constructed as illustrated in FIG. 2 with lines and columns for the individual alarm devices. An address bus AB and a data bus DB connect the microprocessor MP to the memory SP. Additionally, an input field EF is connected to the microprocessor by means of which, as illustrated in FIG. 2, alarm criteria can be inputed to the individual lines of the memory SP. An output or display field, for example a video data terminal DS serves for the monitoring of the system. In the construction according to FIG. 4, the system thus carries out all functions as in the circuit described in FIGS. 1 through 3. However, the employment of the microprocessor enables the production of the required logical sequences and control functions with a minimum of component parts. The individual component elements, such as the microprocessor MP, memory SP, etc., are known per se. Further, by the employment of the microprocessor MP the operation of the system as well as the output of the memory data over the video data terminal become significantly simpler than with the usual basic components, etc.

Although we have described our invention by reference to particular illustrative embodiments, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim as our invention:

1. In a danger alarm system utilizing a plurality of alarm devices connected to a central exchange by means of call circuits, in which the data of the individual alarm devices can be monitored in the central exchange by means of test control units and can be evaluated by means of an evaluation installation for the formation of alarm or trouble signals, the combination of a memory, provided in the central exchange, in which there is stored seizure as well as various characteristic data for each alarm device connectable in the system, an evaluation installation, a line sampling installation for cyclically sampling the individual call circuits and supplying the evaluation installation with alarm data arriving from the individual lines, memory sampling means operatively connecting the memory and evaluation installation for sampling, upon each step of the line sampling installation, the storage locations for all alarm devices connected to the line involved, whereby the memory content is supplied to the evaluation installation for the formation of set values, said evaluation installation including means for comparing the data arriving from the individual call circuits with the set values formed from the stored data, and means responsive to predetermined comparison results for the formation of interference or alarm signals.

2. An alarm system according to claim 1, wherein an input device is provided for programming the individual memory locations in the memory.

3. An alarm system according to claim 1, comprising in further combination, means including a display installation, for monitoring the content of said memory.

4. An alarm system according to claim 1, comprising in further combination, means connecting said evaluation installation to said member for effecting entry of data therefrom into the memory, whereby, upon placing the system in operation, the seizure of the individual call circuits can be determined over the line sampling installation and can be entered into the memory.

5. An alarm system according to claim 4, comprising in further combination, a change-over installation for switching off the evaluation installation during write-in into the memory, and which can only be switched on after the monitoring of the memory content.

6. An alarm system according to claim 1, wherein the individual alarms are operationally grouped in the memory according to their alarm type.

7. An alarm system according to claim 1, wherein the individual alarms are operationally grouped in the memory according to their sensitivity.

8. An alarm system according to claim 1, wherein the individual alarm devices are operationally grouped in the memory according to their response retardation.

9. An alarm system according to claim 1, wherein said evaluation installation comprises a microprocessor.

10. An alarm system according to claim 1, comprising in further combination, means including a display installation, for monitoring the content of said memory.

11. An alarm system according to claim 10, comprising in further combination, means connecting said evaluation installation to said member for effecting entry of data therefrom into the memory, whereby, upon placing the system in operation, the seizure of the individual call circuits can be determined over the line sampling installation and can be entered into the memory.

12. An alarm system according to claim 11, comprising in further combination of a change-over installation for switching off the evaluation installation during write-in into the memory, and which can only be switched on after the monitoring of the memory content.

13. An alarm system according to claim 12, wherein the individual alarms are operationally grouped in the memory according to their alarm type.

14. An alarm system according to claim 12, wherein the individual alarms are operationally grouped in the memory according to their sensitivity.

15. An alarm according to claim 12, wherein the individual alarm devices are operationally grouped in the memory according to their response retardation.

16. An alarm system according to claim 12, wherein said evaluation installation comprises a microprocessor.

* * * * *